US007910850B2

(12) United States Patent
Puhalla et al.

(10) Patent No.: US 7,910,850 B2
(45) Date of Patent: Mar. 22, 2011

(54) ELECTRICAL SWITCHING APPARATUS AND PUSH-TO-TRIP ASSEMBLY THEREFOR

(75) Inventors: Craig J. Puhalla, Moon Township, PA (US); Kelly J. McCarthy, Pittsburgh, PA (US); Mark A. Janusek, Pittsburgh, PA (US); Ronald W. Brand, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 493 days.

(21) Appl. No.: 12/135,506

(22) Filed: Jun. 9, 2008

(65) Prior Publication Data

US 2009/0301850 A1 Dec. 10, 2009

(51) Int. Cl.
*H01H 23/00* (2006.01)

(52) U.S. Cl. ..... 200/401; 335/35; 335/173

(58) Field of Classification Search ..... 200/520
See application file for complete search history.

(56) References Cited

U.S. PATENT DOCUMENTS

| | | | | |
|---|---|---|---|---|
| 3,826,951 | A * | 7/1974 | Mater et al. | 361/100 |
| 4,000,478 | A * | 12/1976 | Jencks et al. | 335/34 |
| 6,111,486 | A | 8/2000 | Fischer et al. | |
| 6,229,418 | B1 | 5/2001 | Mueller et al. | |
| 6,232,855 | B1 * | 5/2001 | Malingowski et al. | 335/14 |
| 6,700,082 | B1 | 3/2004 | Gibson et al. | |

* cited by examiner

*Primary Examiner* — Renee Luebke
*Assistant Examiner* — Lheiren Mae A Caroc
(74) *Attorney, Agent, or Firm* — Martin J. Moran

(57) ABSTRACT

A push-to-trip assembly is provided for an electrical switching apparatus, such as a circuit breaker. The push-to-trip assembly includes a push-to-trip actuator having first and second ends and being movable among a first position corresponding to the circuit breaker separable contacts being closeable, and a second position corresponding to the second end cooperating with a trip bar to cause the circuit breaker operating mechanism to trip open the separable contacts. The first end is accessible from the exterior of the housing to actuate the push-to-trip actuator from the first position to the second position. A biasing element biases the push-to-trip actuator away from the base toward the first position. At least one cover stop of the push-to-trip actuator engages a corresponding portion of the housing cover to stop movement of the push-to-trip actuator. An overtravel restraint proximate the second end of the push-to-trip actuator restrains movement of the trip bar.

20 Claims, 5 Drawing Sheets

ELECTRICAL SWITCHING APPARATUS AND PUSH-TO-TRIP ASSEMBLY THEREFOR

BACKGROUND OF THE INVENTION

1. Field of the Invention

The invention relates generally to electrical switching apparatus and, more particularly, to electrical switching apparatus, such as circuit breakers. The invention also relates to push-to-trip assemblies for electrical switching apparatus.

2. Background Information

Electrical switching apparatus, such as circuit interrupters, generally include at least one pair of separable contacts which are operated either manually, by way of a handle and/or another suitable manually operated trip actuator accessible on the exterior of the circuit interrupter housing, or automatically by way of a trip unit in response to a trip condition (e.g., without limitation, an overcurrent condition; a relatively high level short circuit or fault condition; a ground fault or arc fault condition).

FIG. 1 shows a molded case circuit breaker 1 employing a manually operated trip actuator in the form of a push-to-trip assembly 3. The push-to-trip assembly 3 includes a push-to-trip button 5 having a first end 7, a second end 9 disposed opposite and distal from the first end 7, and a biasing element 11 (e.g., spring). The first end 7 of the push-to-trip button 5 is accessible at or about the exterior 13 of the circuit breaker housing 15 (partially shown in phantom line drawing). The spring 11 biases the second end 9 of the push-to-trip button 5 toward the exterior 13 of the circuit breaker housing 15. When the push-to-trip button 5 is pushed inward, against the bias of the spring 11, the second end 9 cooperates with the trip bar 17 of the circuit breaker 1 to cause the circuit breaker operating mechanism 19 to trip open the separable electrical contacts 21,23 (partially shown) in response to a trip condition.

Among other disadvantages, it is difficult to hold the various components (e.g., without limitation, push-to-trip button 5; spring 11; trip bar 17) of the push-to-trip assembly 3 and/or circuit breaker 1 together during assembly of the circuit breaker 1. Specifically, the push-to-trip button 5, which is spring-biased, is dependent on an external stop such as, for example, the housing 15 (e.g., cover) of the circuit breaker 1 to hold it in place. Further complicating the assembly process is the fact that the spring 11 also, directly or indirectly, biases the trip bar 17 of the circuit breaker 1. Specifically, absent a suitable stopping mechanism for resisting undesired rotation of the trip bar 17, it is difficult to achieve the desired orientation of the trip bar 17 during assembly of the circuit breaker 1. For example, assembly of the circuit breaker 1 is reliant upon the trip bar 17 abutting bimetal 25 of circuit breaker heater assembly 27. It would be preferable to avoid such abutment. Moreover, in circumstances where the push-to-trip assembly 3 and/or the trip bar 17 is/are assembled and installed in the circuit breaker 1 before the installation of the heater assembly 27, the bimetal 25 is not available for use as a stop to resist over rotation of the trip bar 17.

There is, therefore, room for improvement in electrical switching apparatus and in push-to-trip assemblies therefor.

SUMMARY OF THE INVENTION

These needs and others are met by embodiments of the invention, which are directed to a push-to-trip assembly for an electrical switching apparatus, wherein the push-to-trip assembly includes a number of structures to facilitate assembly of the electrical switching apparatus.

As one aspect of the invention, a push-to-trip assembly is provided for an electrical switching apparatus. The electrical switching apparatus includes a housing, separable contacts and a trip bar cooperating with an operating mechanism to trip open the separable contacts. The housing includes a base, a cover coupled to the base, and an exterior. The push-to-trip assembly comprises: a push-to-trip actuator structured to be movably coupled to the base of the housing, the push-to-trip actuator comprising a first end and a second end disposed opposite and distal from the first end, the push-to-trip actuator being further structured to move among a first position corresponding to the separable contacts being closeable, and a second position corresponding to the second end of the push-to-trip actuator cooperating with the trip bar to cause the operating mechanism to trip open the separable contacts, the first end of the push-to-trip actuator being structured to be accessible from the exterior of the housing to actuate the push-to-trip actuator from the first position to the second position; a biasing element structured to bias the push-to-trip actuator away from the base of the housing toward the first position; at least one cover stop disposed on the push-to-trip actuator, the at least one cover stop being structured to engage a corresponding portion of the cover of the housing to stop movement of the push-to-trip actuator away from the base of the housing; and an overtravel restraint disposed proximate the second end of the push-to-trip actuator, the overtravel restraint being structured to restrain movement of the trip bar.

The cover of the housing may be a primary cover disposed on the base of the housing and a secondary cover coupled to the primary cover, and the at least one cover stop may be a primary cover stop and a secondary cover interface. The primary cover stop may be disposed on the push-to-trip actuator between the first end of the push-to-trip actuator and the second end of the push-to-trip actuator. When the primary cover is disposed on the base and the secondary cover is not coupled to the primary cover, the primary cover stop may be structured to engage the primary cover. The secondary cover interface may be disposed at or about the first end of the push-to-trip actuator. When the secondary cover is coupled to the primary cover and the push-to-trip actuator is disposed in the first position, the secondary cover interface may be structured to engage the secondary cover of the housing.

The trip bar may comprise at least one protrusion extending laterally outwardly from the trip bar. The push-to-trip actuator may further comprise an engagement segment extending outwardly from the push-to-trip actuator at or about the second end thereof. When the push-to-trip actuator is actuated from the first position toward the second position, the engagement segment may be structured to engage a corresponding one of the at least one protrusion of the trip bar, thereby moving the trip bar to cause the operating mechanism to trip open the separable contacts of the electrical switching apparatus. The overtravel restraint of the push-to-trip actuator may comprise a restraint segment disposed opposite and spaced apart from the engagement segment of the push-to-trip actuator. The overtravel restraint may be structured to receive a corresponding one of the at least one protrusion of the trip bar between the engagement segment of the push-to-trip actuator and the restraint segment of the overtravel restraint in order to restrain movement of the trip bar. The at least one protrusion of the trip bar may include a first protrusion extending laterally outwardly from the trip bar and a second protrusion extending laterally outwardly from the trip bar generally opposite the first protrusion, and the push-to-trip actuator may further comprise an interlock extending outwardly from the push-to-trip actuator at or about the second end thereof. The overtravel restraint may be structured to receive the first protrusion of the trip bar between the engagement segment of the push-to-trip actuator and the restraint segment of the overtravel restraint, and the interlock of the push-to-trip actuator may be structured to cooperate with the second protrusion of the trip bar.

As another aspect of the invention, a push-to-trip assembly is provided for an electrical switching apparatus. The electrical switching apparatus includes a housing, separable contacts and an operating mechanism structured to open and close the separable contacts. The housing includes a base, a primary cover disposed on the base, a secondary cover coupled to the primary cover and an exterior. The push-to-trip assembly comprises: a push-to-trip actuator structured to be movably coupled to the base of the housing, the push-to-trip actuator comprising a first end and a second end disposed opposite and distal from the first end, the push-to-trip actuator being further structured to move among a first position corresponding to the separable contacts being closeable, and a second position corresponding to the second end of the push-to-trip actuator cooperating with the operating mechanism to open the separable contacts, the first end of the push-to-trip actuator being structured to be accessible from the exterior of the housing to actuate the push-to-trip actuator from the first position to the second position; a biasing element structured to bias the push-to-trip actuator away from the base of the housing toward the first position; a primary cover stop disposed on the push-to-trip actuator between the first end of the push-to-trip actuator and the second end of the push-to-trip actuator, the primary cover stop being structured to stop movement of the push-to-trip actuator away from the base of the housing when the primary cover is disposed on the base of the housing and the secondary cover of the housing is not coupled to the primary cover; and a secondary cover interface disposed at or about the first end of the push-to-trip actuator, the secondary cover interface being structured to engage the secondary cover of the housing when the secondary cover is coupled to the primary cover of the housing and the push-to-trip actuator is disposed in the first position.

As another aspect of the invention, an electrical switching apparatus comprises: a housing including a base, a primary cover disposed on the base, a secondary cover coupled to the primary cover, and an exterior; separable contacts enclosed by the housing; an operating mechanism structured to open and close the separable contacts; a trip bar cooperating with the operating mechanism to trip open the separable contacts; and a push-to-trip assembly comprising: a push-to-trip actuator movably coupled to the base of the housing, the push-to-trip actuator comprising a first end and a second end disposed opposite and distal from the first end, the push-to-trip actuator being movable among a first position corresponding to the separable contacts being closeable, and a second position corresponding to the second end of the push-to-trip actuator cooperating with the trip bar to cause the operating mechanism to trip open the separable contacts, the first end of the push-to-trip actuator being accessible from the exterior of the housing to actuate the push-to-trip actuator from the first position to the second position, a biasing element biasing the push-to-trip actuator away from the base of the housing toward the first position, a primary cover stop disposed on the push-to-trip actuator between the first end of the push-to-trip actuator and the second end of the push-to-trip actuator, the primary cover stop stopping movement of the push-to-trip actuator away from the base of the housing when the primary cover is disposed on the base of the housing and the secondary cover of the housing is not coupled to the primary cover, a secondary cover interface disposed at or about the first end of the push-to-trip actuator, the secondary cover interface engaging the secondary cover of the housing when the secondary cover is coupled to the primary cover of the housing and the push-to-trip actuator is disposed in the first position, and an overtravel restraint disposed proximate to the second end of the push-to-trip actuator, the overtravel restraint restraining movement of the trip bar.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
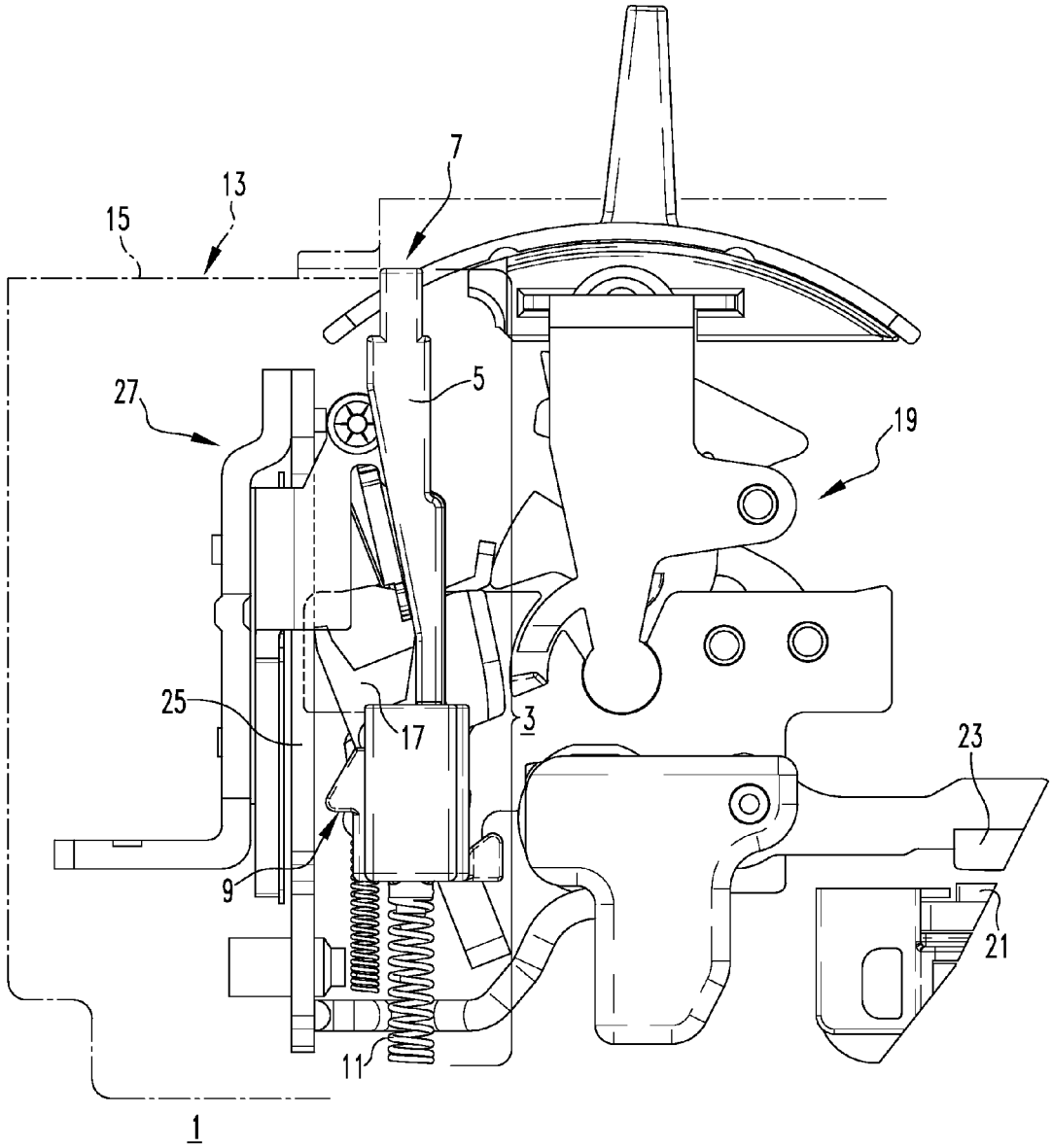
FIG.1 PRIOR ART
FIG. 1 is a side elevation view of a portion of a circuit breaker and a push-to-trip assembly therefor.

Directional phrases used herein, such as, for example, left, right, downward, upward, clockwise, counterclockwise, top, bottom and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, rivets, screws, bolts and the combinations of bolts and nuts (e.g., without limitation, lock nuts), and bolts, washers and nuts, as well as connecting mechanisms that do not require a separate fastening element (e.g., without limitation, a rivet; a screw; a bolt and a nut; a combination of bolts, washers and nuts) such as, for example and without limitation, an arrangement of interlocking protrusions or projections (e.g., without limitation, tabs) and apertures (e.g., without limitation, openings; recesses; holes; slots).

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
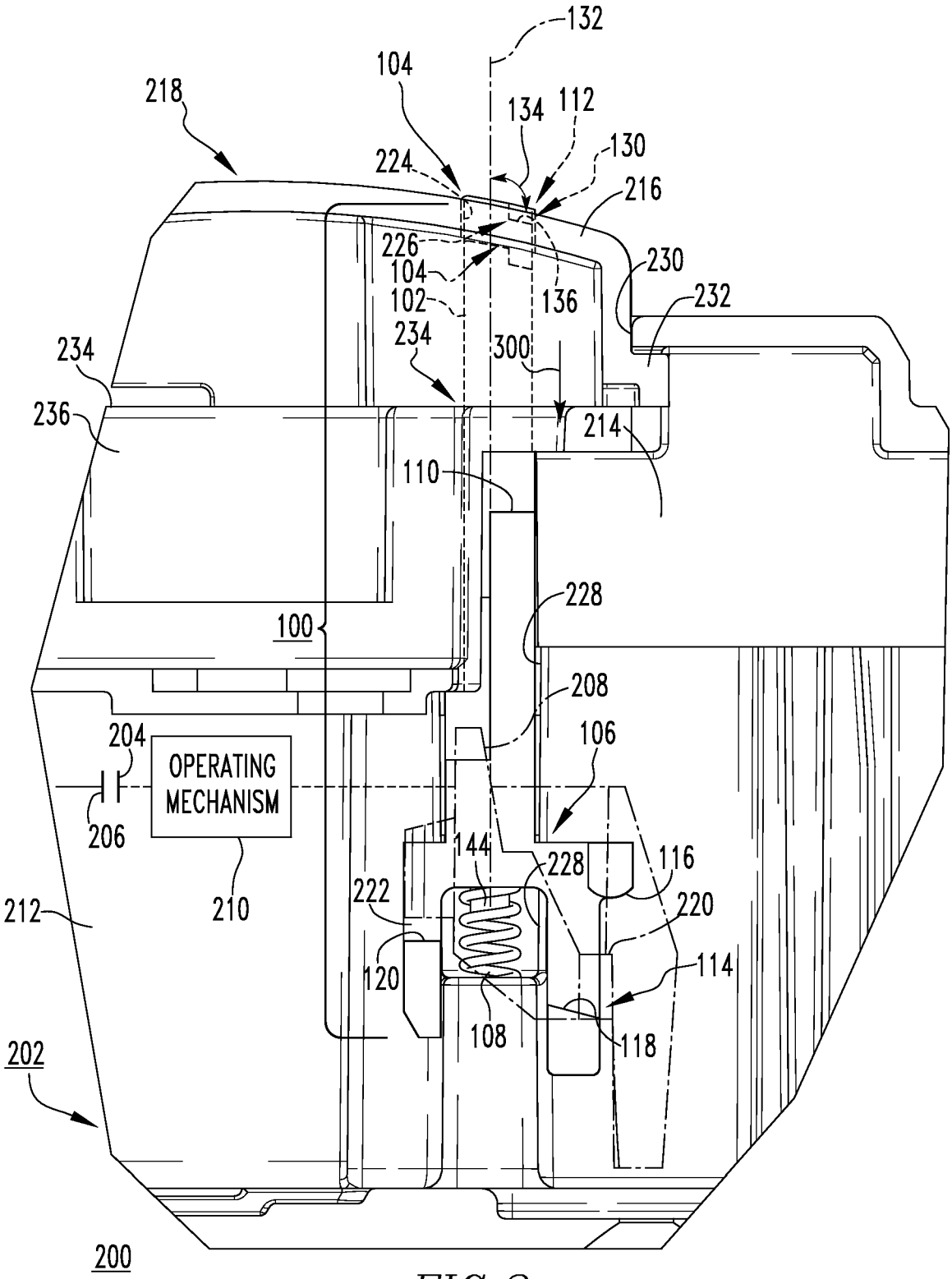
FIG. 2 is a side elevation view of a portion of a circuit breaker and a push-to-trip assembly therefor, in accordance with an embodiment of the invention.

FIG. 2 shows a push-to-trip assembly 100 for an electrical switching apparatus, such as a circuit breaker 200 (partially shown in FIG. 2). The circuit breaker 200 includes a housing 202 (partially shown), separable contacts 204,206 (shown in simplified form in FIG. 2) enclosed by the housing 202, and a trip bar 208, which cooperates with the circuit breaker operating mechanism 210 (shown in simplified form in hidden line drawing in FIG. 2) to trip open the separable contacts 204,206. The circuit breaker housing 202 includes a base 212 and a cover 214,216. As described hereinbelow, the example cover is a primary cover 214 disposed on the base 212 and a secondary cover 216 coupled to the primary cover 214.

Figure 3A:
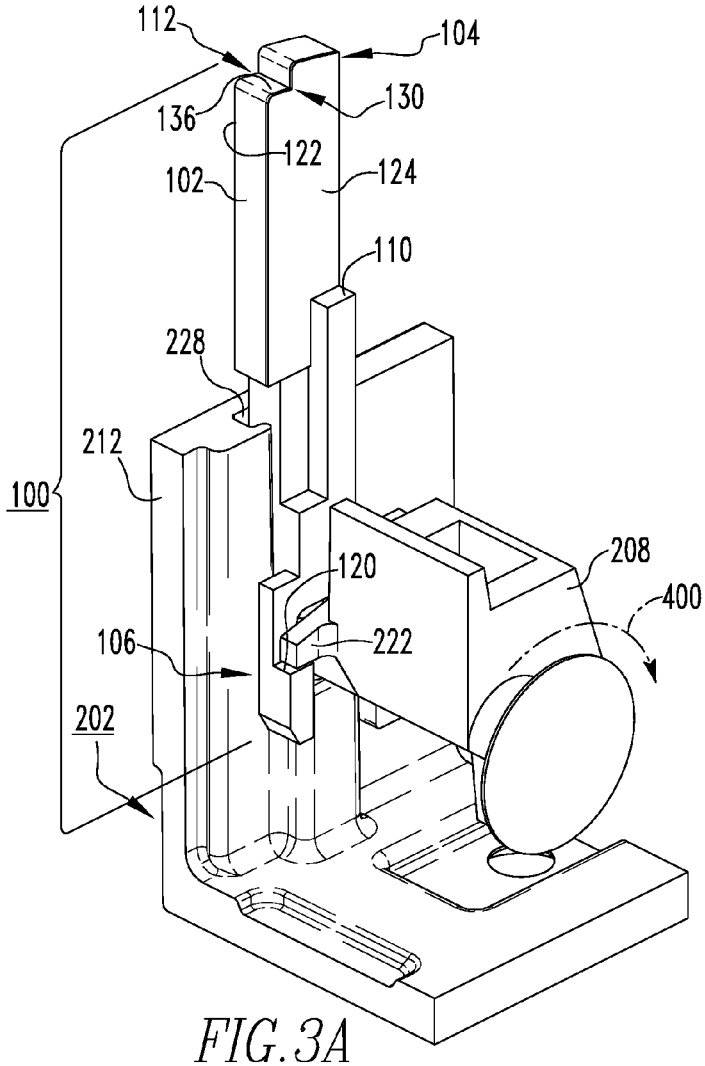
FIG. 3A is an isometric view of one side of a portion of the push-to-trip assembly of FIG. 2, also showing a portion of the circuit breaker trip bar.
Figure 3B:
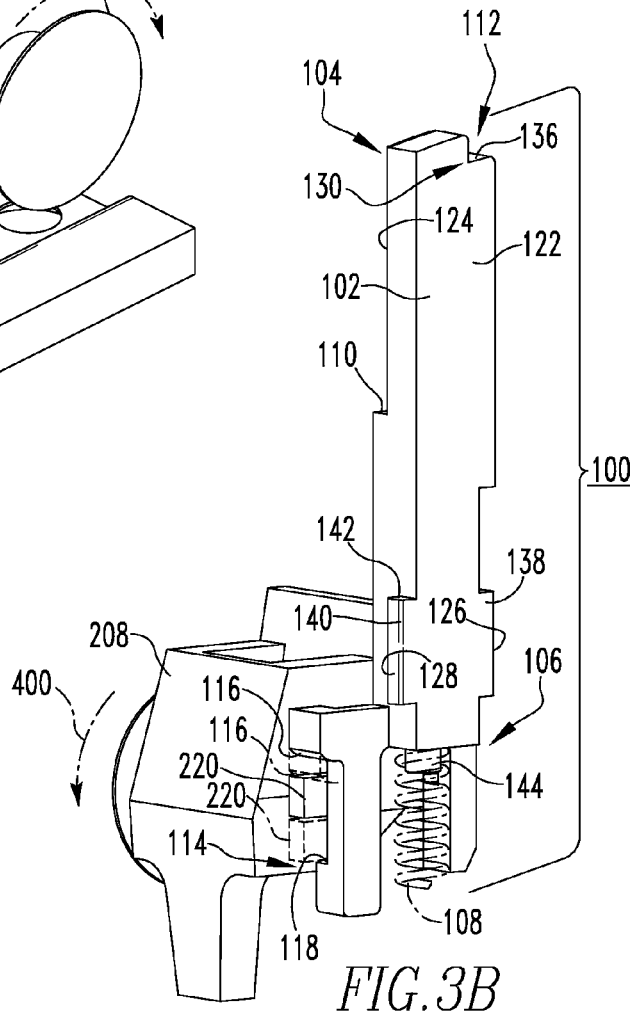
FIG. 3B is an isometric view of the opposite side of the push-to-trip assembly of FIG. 3A.

Continuing to refer to FIG. 2, and also to FIGS. 3A and 3B, the push-to-trip assembly 100 includes a push-to-trip actuator 102 (e.g., without limitation, a button), which is movably coupled to the base 212 of the circuit breaker housing 202 (FIGS. 2 and 3A). For simplicity of illustration, only a relatively small segment of the base 212 of the circuit breaker housing 202 is shown in FIG. 3A. The push-to-trip actuator 102 is structured to move among a first position (shown in FIGS. 2 and 4B), corresponding to the separable contacts 204,206 (FIG. 2) being closeable, and a second position (shown in phantom line drawing in FIG. 2), corresponding to the first end 104 of the push-to-trip actuator 102 being depressed (e.g., downward from the perspective of FIG. 2) such that the second end 106 of the push-to-trip actuator 102 cooperates with the trip bar 208 to cause the operating mechanism 210 (FIG. 2) to trip open the separable contacts 204,206 (FIG. 2). Accordingly, it will be appreciated that the first end 104 of the push-to-trip actuator 102 is accessible from the exterior 218 of the housing 202, where it is actuatable to move the push-to-trip actuator 102 from the first position to the second position.

A biasing element such as, for example and without limitation, a spring 108 (FIG. 2; also shown in phantom line drawing in FIG. 3B, and in FIGS. 4A and 4B), biases the push-to-trip actuator 102 away from the base 212 of the circuit breaker housing 202 toward the first position. At least one cover stop 110,112 (both shown in FIGS. 3A and 3B) is disposed on the push-to-trip actuator 102, and is structured to engage a portion of a corresponding one of the primary cover 214 and/or the secondary cover 216 of the circuit housing 202 to stop movement of the push-to-trip actuator 102 away from the base 212 of the housing 202, as desired. As will be described in greater detail hereinbelow, the push-to-trip actuator 102 of the example push-to-trip assembly 100 includes two cover stops, a primary cover stop 110 and a secondary cover interface 112, both of which are shown in FIGS. 3A and 3B.

The example push-to-trip assembly 100 further includes an overtravel restraint 114 (FIGS. 2 and 3B), which is disposed proximate the second end 106 of the push-to-trip actuator 102, and is structured to restrain movement of the trip bar 208 (partially shown in FIG. 3B). More specifically, the trip bar 208 includes a first protrusion 220 extending laterally outwardly from the trip bar 208 in a first direction (e.g., to the right from the perspective of FIG. 2; to the left from the perspective of FIG. 3B) and a second protrusion 222 extending laterally outwardly from the trip bar 208 generally opposite the first protrusion 220 (e.g., to the left from a perspective of FIG. 2; to the left from the perspective of FIG. 3A), and the push-to-trip actuator 102 further includes an engagement segment 116 (FIGS. 2 and 3B), which extends outwardly from the push-to-trip actuator 102 at or about the second end 106 thereof. When the push-to-trip actuator 102 is actuated in the direction indicated by arrow 300 of FIG. 2, from the first position toward the second position, the engagement segment 116 engages the first protrusion 220 of the trip bar 208, as shown in phantom line drawing in FIG. 3B, thereby moving (e.g., pivoting counterclockwise from the perspective of FIG. 3B, as indicated by arrow 400) the trip bar 208 to cause the operating mechanism 210 (FIG. 2) to trip open the separable contacts 204,206 (FIG. 2) of the circuit breaker 200.

The aforementioned overtravel restraint 114 of the push-to-trip actuator 102 includes a restraint segment 118 (FIGS. 2 and 3B), which is disposed opposite and spaced apart from the engagement segment 116 of the push-to-trip actuator 102. Accordingly, the first protrusion 220 of the trip bar 208 is disposed between the engagement segment 116 of the push-to-trip actuator 102 and the restraint segment 118 of the overtravel restraint 114, as shown in FIGS. 2 and 3B, in order to restrain movement of the trip bar 208. In this manner, the disclosed push-to-trip assembly 100 and, in particular, the overtravel restraint 114 thereof, functions to maintain the trip bar 208 in the desired orientation during assembly of the circuit breaker 200 (FIG. 2). Specifically, unlike known push-to-tip assemblies (see, for example, push-to-trip assembly 3 of FIG. 1), which are reliant upon an external stop mechanism or suitable structure (see, for example, bimetal 25 of heater assembly 27 of FIG. 1) to restrain movement of the trip bar (see, for example, trip bar 17 abutting bimetal 25 of FIG. 1) to achieve and/or maintain the desired orientation of the trip bar (e.g., 17), the disclosed push-to-trip assembly 100, by virtue of the aforementioned overtravel restraint 114, is not reliant upon any external stop mechanism or structure to restrain movement of the trip bar 208.

As best shown in FIG. 3A, the second protrusion 222 of the example trip bar 208 cooperates with an interlock 120. The interlock 120 extends outwardly from the push-to-trip actuator 102 at or about the second end 106 thereof. The interlock 120 functions to resist undesired movement (e.g., without limitation, pivoting counterclockwise from the perspective of FIG. 3A). Thus, it will be appreciated that movement of the trip bar 208 is restrained between the position shown in FIG. 3A, in which the second protrusion 222 of the trip bar 208 abuts the interlock 120 of the push-to-trip actuator 102, and the position partially shown in phantom line drawing in FIG. 3B, in which the first protrusion 220 of the trip bar 208 abuts the restraint segment 118 of the overtravel restraint 114. It will, however, be appreciated that the trip bar (e.g., 208) could include any suitable alternative number and/or configuration of protrusions (not shown) other than first and second protrusions 220 (FIGS. 2 and 3B), 222 (FIGS. 2 and 3A), without departing from the scope of the invention.

Figure 4A:
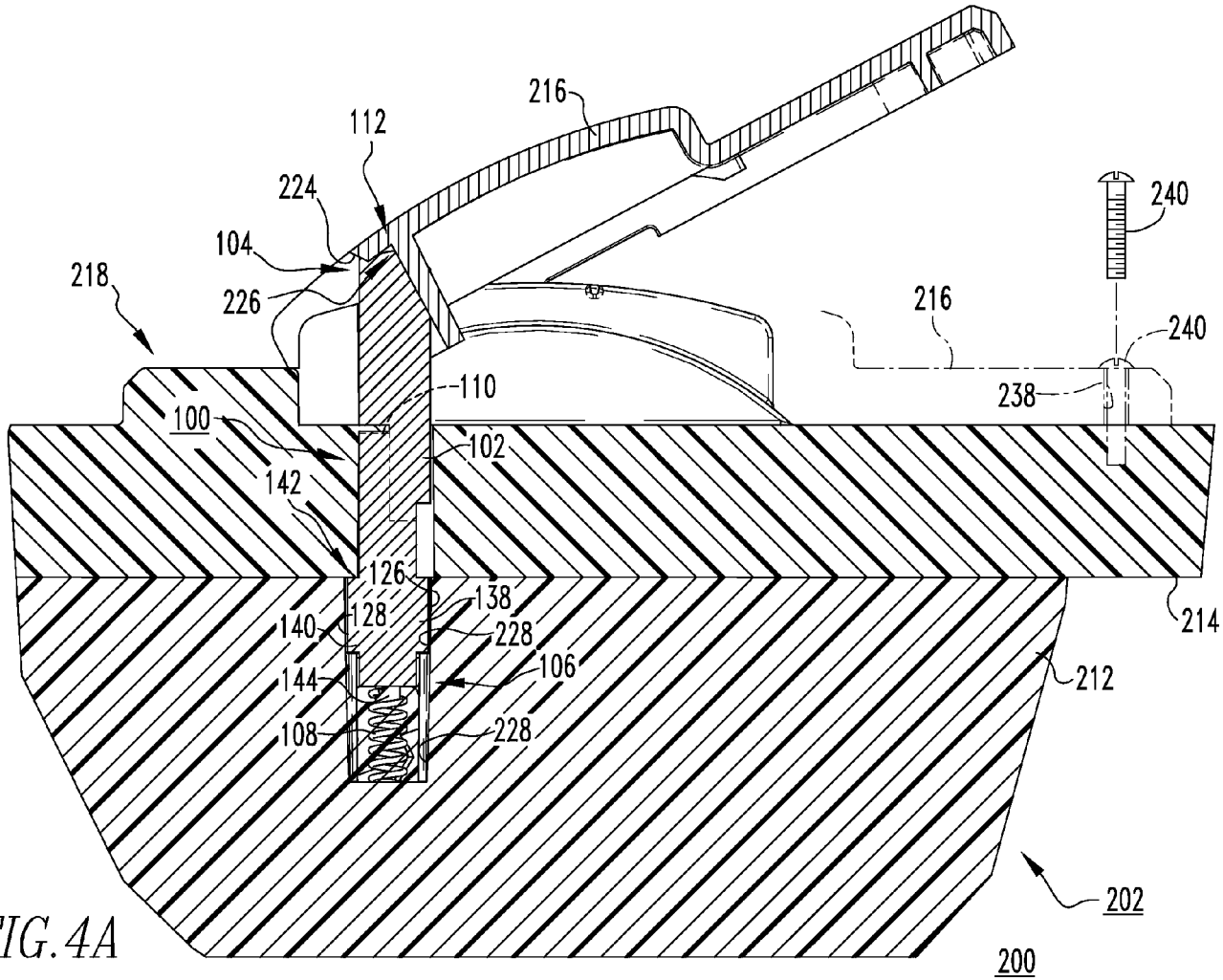
FIG. 4A is a sectional view of a portion of the push-to-trip assembly of FIG. 2, shown cooperating with a secondary cover of the circuit breaker in accordance with an embodiment of the invention.
Figure 4B:
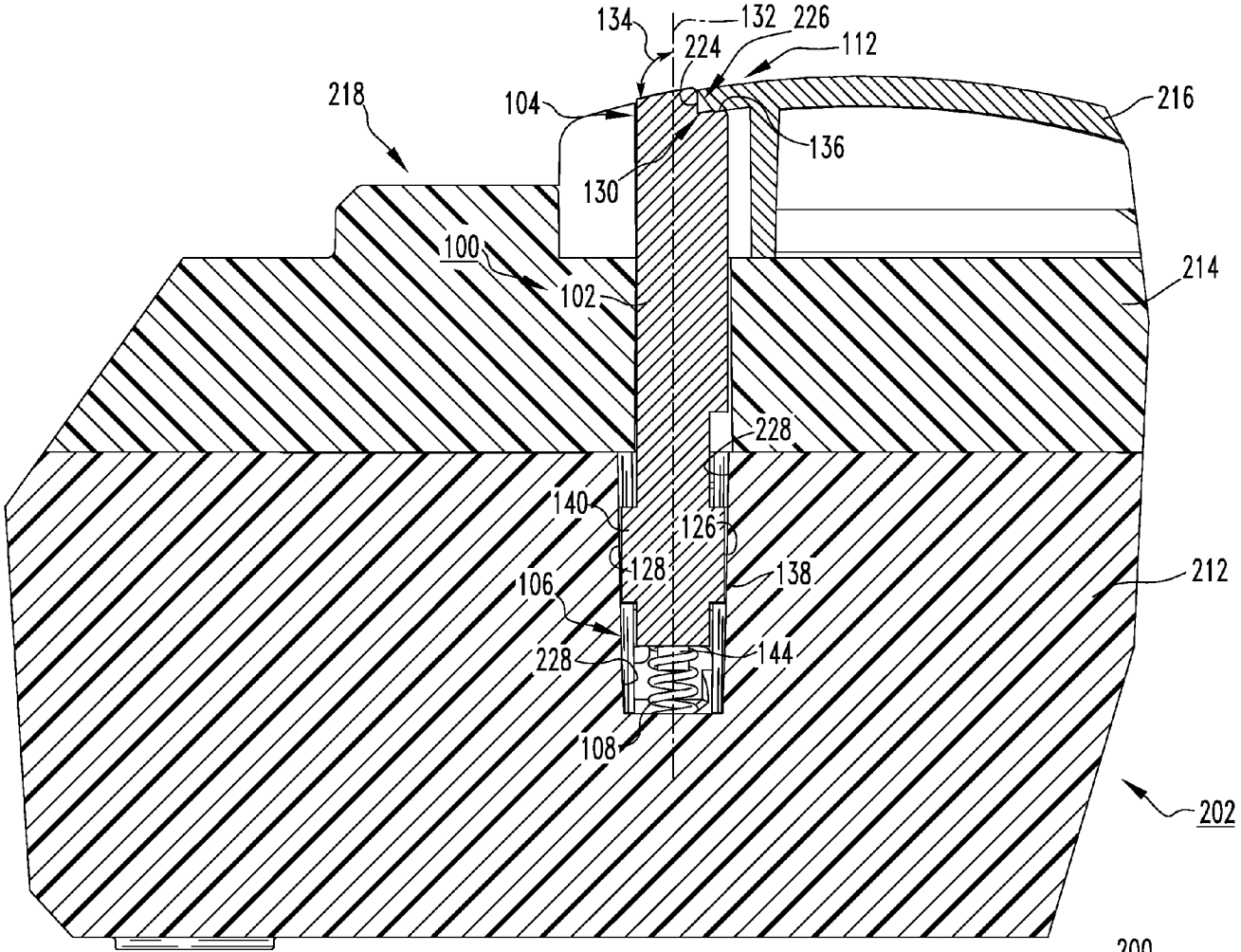
FIG. 4B is a sectional view of a portion of the push-to-trip assembly of FIG. 4A, modified to shown the secondary cover of the circuit breaker in the fully assembled position.

The interlock 120 of the push-to-trip actuator 102 is generally opposite and spaced apart from the overtravel restraint 114, as shown in FIGS. 2 and 3B. The spring 108 (shown in phantom line drawing in FIG. 3B) of the push-to-trip assembly 100 is generally disposed within a channel 228 of the base 212 of the circuit breaker housing 202 (as shown in FIGS. 2, 3A, 4A and 4B). The spring 108 is also partially disposed between, and is parallel with respect to, the interlock 120 and the overtravel restraint 114, and extends from the base 212 of the circuit breaker housing 202 to engage a spring seat 144 at the second end 106 of the push-to-trip actuator 102, as shown in FIG. 2. The push-to-trip actuator 102 is movably secured within the channel 228 by first and second lateral protrusions 138,140, which extend outwardly from the first and second edges 126,128, respectively, of the push-to-trip actuator 102, as shown in FIGS. 3B, 4A and 4B. It will, however, be appreciated that any known or suitable alternative number and/or configuration of protrusions (not shown) or other suitable structures (not shown) could be employed to suitably movably retain the push-to-trip actuator 102 within the channel 228.

As noted previously, the push-to-trip actuator 102 of the example push-to-trip assembly 100 includes a primary cover stop 110 (FIGS. 2, 3A and 3B; also shown in hidden line drawing in FIG. 4A), and a secondary cover interface 112 (FIGS. 2-4B). The primary cover stop 110 is disposed between the first and second ends 104,106 of the push-to-trip actuator 102, and extends outwardly from the second side 124 opposite the first side 122 thereof, as shown in FIGS. 3A and 3B. When the primary cover 214 is disposed on the base 212 of the circuit breaker housing 202 and the secondary cover 216 is not coupled to the primary cover 214, for example and without limitation, when the secondary cover 216 is being removed as shown in solid line drawing in FIG. 4A, the primary cover stop 110 abuts the primary cover 214 of the circuit breaker housing 202. In this manner, the primary cover 214 serves to resist undesired movement of the push-to-trip actuator 102 away from the base 212 of the circuit breaker housing 202, and functions to hold the push-to-trip assembly 100 together, without requiring a separate external stopping mechanism (e.g., without limitation, secondary cover 216).

Continuing to refer to FIG. 4A, in addition to the primary cover stop 110, the aforementioned second lateral protrusion 140, which extends outwardly from the second side 128 of the push-to-trip actuator 102, can additionally or alternatively engage a corresponding portion of the primary cover 214 of the circuit breaker housing 202 to stop movement of the push-to-trip actuator 102, as desired. Specifically, the second lateral protrusion 140 in the example of FIG. 4A includes a surface 142, which abuts the primary cover 214 when the secondary cover 216 is not fastened to the primary cover 214 in the manner shown in phantom line drawing in FIG. 4A and described hereinbelow.

The secondary cover interface 112 is disposed at or about the first end 104 of the push-to-trip actuator 102 and, in the example shown and described herein, consists of a notch 130 and a contact surface 136, which is structured to engage the secondary cover 216 at an opening 224 thereof, as best shown in FIG. 4B. Specifically, when the push-to-trip actuator 102 is disposed in the first position, shown in FIG. 4B, the notch 130 and, in particular, the contact surface 136 thereof, engages the edge 226 of the secondary cover opening 224. In the example shown and described herein, the notch 130 is parallel with respect to the first end 104 of the push-to-trip actuator 102. Specifically, as best shown in FIG. 4B, the first end 104 of the push-to-trip actuator 102 is disposed at an angle 134 with respect to the longitudinal axis 132 of the push-to-trip actuator 102. The angle 134 is preferably, but not necessarily greater than 90 degrees. Additionally, the contact surface 136 of the aforementioned notch 130 is preferably generally parallel with respect to the first end 104 of the push-to-trip actuator 102, as shown. Among other benefits, this configuration of the secondary cover interface 112 accommodates movement of the secondary cover 216 of the circuit breaker housing 202, such that it can be slid and/or pivoted in order to be coupled to the primary cover 214, as will now be discussed. Attachment of the secondary cover 216 to the primary cover 214 is further facilitated by the fact that the edges of the first end 104 at the notch 130 thereof are rounded, as best shown in FIG. 3A, to cooperate with the secondary cover opening 224, which is chamfered (e.g., angled) as best shown in FIG. 4A.

Specifically, as shown in FIG. 2, the primary cover 214 of the circuit breaker housing 202 includes a number of apertures 230 (one is shown), and the secondary cover 216 of the circuit breaker housing 202 includes a number of protrusions 232 (one is shown). When the secondary cover 216 is coupled to the primary cover 214, as shown (see also secondary cover 216 partially shown in phantom line drawing fastened to the primary cover 214 in FIG. 4A), each of the protrusions 232 (e.g., tabs) of the secondary cover 216 is disposed in a corresponding one of the apertures 230 of the primary cover 214. In operation, the tab 232 is inserted (e.g., slid) into the aperture 230 and the secondary cover 216 is pivoted from the position shown in solid line drawing in FIG. 4A to the position partially shown in phantom line drawing in FIG. 4A (also partially shown in FIGS. 2 and 4B). It will be appreciated that, while a single aperture 230 and one corresponding protrusion 232 are shown herein for simplicity of illustration, that any known or suitable alternative number and/or configuration of apertures (e.g., 230) and/or protrusions (e.g., 232) could be employed, without departing from the scope of the invention. The primary cover 214 of the example circuit breaker 200 further includes an outer surface 234 and a number of cavities 236 (one cavity 236 is shown in FIG. 2) extending inwardly from the outer surface 234 toward the base 212 of the circuit breaker housing 202, as shown in FIG. 2. When the secondary cover 216 is fastened to the primary cover 214, as partially shown in phantom line drawing in FIG. 4A, the secondary cover 216 covers the cavity 236 (FIG. 2) of the primary cover 214. As shown in FIG. 4A, the secondary cover 216 of the example circuit breaker 200 further includes at least one hole 238 and at least one fastener 240. Each fastener 240 is inserted through a corresponding hole (e.g., one hole 238 is shown in phantom line drawing FIG. 4A) of the secondary cover 216 and is fastened to fasten the secondary cover 216 to the primary cover 214, as partially shown in phantom line drawing. It will be appreciated that any known or suitable number and/or configuration of holes (e.g., 238) and fasteners (e.g., 240), as defined herein, could be employed within the scope of the invention.

Accordingly, the disclosed push-to-trip assembly 100 manual trip actuator (e.g., push-to-trip actuator 102), which cooperates with the circuit breaker operating mechanism (e.g., trip bar 208) and/or the circuit breaker cover (e.g., primary cover 214; secondary cover 216) in order to facilitate the assembly of the circuit breaker 200, and to control the movement of the push-to-trip actuator 102, as desired.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A push-to-trip assembly for an electrical switching apparatus, said electrical switching apparatus including a housing, separable contacts and a trip bar cooperating with an operating mechanism to trip open said separable contacts, said housing including a base, a cover coupled to the base, and an exterior, said push-to-trip assembly comprising:

a push-to-trip actuator structured to be movably coupled to the base of said housing, said push-to-trip actuator comprising a first end and a second end disposed opposite and distal from the first end, said push-to-trip actuator being further structured to move among a first position corresponding to said separable contacts being closeable, and a second position corresponding to the second end of said push-to-trip actuator cooperating with said trip bar to cause said operating mechanism to trip open said separable contacts, the first end of said push-to-trip actuator being structured to be accessible from the exterior of said housing to actuate said push-to-trip actuator from said first position to said second position;

a biasing element structured to bias said push-to-trip actuator away from the base of said housing toward said first position;

at least one cover stop disposed on said push-to-trip actuator, said at least one cover stop being structured to engage a corresponding portion of the cover of said housing to stop movement of said push-to-trip actuator away from the base of said housing; and an overtravel restraint disposed proximate the second end of said push-to-trip actuator, said overtravel restraint being structured to restrain movement of said trip bar.

2. The push-to-trip assembly of claim 1 wherein the cover of said housing is a primary cover disposed on the base of said housing and a secondary cover coupled to the primary cover; wherein said at least one cover stop is a primary cover stop and a secondary cover interface; wherein said primary cover stop is disposed on the push-to-trip actuator between the first end of said push-to-trip actuator and the second end of said push-to-trip actuator; wherein, when the primary cover is disposed on the base and the secondary cover is not coupled to the primary cover, said primary cover stop is structured to engage the primary cover; wherein said secondary cover interface is disposed at or about the first end of said push-to-trip actuator; and wherein, when the secondary cover is coupled to the primary cover and said push-to-trip actuator is disposed in said first position, said secondary cover interface is structured to engage the secondary cover of said housing.

3. The push-to-trip assembly of claim 1 wherein said trip bar comprises at least one protrusion extending laterally outwardly from said trip bar; wherein said push-to-trip actuator further comprises an engagement segment extending outwardly from said push-to-trip actuator at or about the second end of said push-to-trip actuator; and wherein, when said push-to-trip actuator is actuated from the first position toward the second position, said engagement segment is structured to engage a corresponding one of said at least one protrusion of said trip bar, thereby moving said trip bar to cause said operating mechanism to trip open said separable contacts of said electrical switching apparatus.

4. The push-to-trip assembly of claim 3 wherein said overtravel restraint of said push-to-trip actuator comprises a restraint segment disposed opposite and spaced apart from said engagement segment of said push-to-trip actuator; and wherein said overtravel restraint is structured to receive a corresponding one of said at least one protrusion of said trip bar between said engagement segment of said push-to-trip actuator and said restraint segment of said overtravel restraint in order to restrain movement of said trip bar.

5. The push-to-trip assembly of claim 4 wherein said at least one protrusion of said trip bar includes a first protrusion extending laterally outwardly from said trip bar and a second protrusion extending laterally outwardly from said trip bar generally opposite said first protrusion; wherein said push-to-trip actuator further comprises an interlock extending outwardly from said push-to-trip actuator at or about the second end of said push-to-trip actuator; wherein said overtravel restraint is structured to receive the first protrusion of said trip bar between said engagement segment of said push-to-trip actuator and said restraint segment of said overtravel restraint; and wherein said interlock of said push-to-trip actuator is structured to cooperate with said second protrusion of said trip bar.

6. The push-to-trip assembly of claim 5 wherein said interlock of said push-to-trip actuator is generally disposed opposite and spaced apart from said overtravel restraint of said push-to-trip actuator; wherein said biasing element is a spring; and wherein said spring is disposed between said interlock and said overtravel restraint.

7. A push-to-trip assembly for an electrical switching apparatus, said electrical switching apparatus including a housing, separable contacts and an operating mechanism structured to open and close said separable contacts, said housing including a base, a primary cover disposed on the base, a secondary cover coupled to the primary cover and an exterior, said push-to-trip assembly comprising:

a push-to-trip actuator structured to be movably coupled to the base of said housing, said push-to-trip actuator comprising a first end and a second end disposed opposite and distal from the first end, said push-to-trip actuator being further structured to move among a first position corresponding to said separable contacts being closeable, and a second position corresponding to the second end of said push-to-trip actuator cooperating with said operating mechanism to open said separable contacts, the first end of said push-to-trip actuator being structured to be accessible from the exterior of said housing to actuate said push-to-trip actuator from said first position to said second position;

a biasing element structured to bias said push-to-trip actuator away from the base of said housing toward said first position;

a primary cover stop disposed on said push-to-trip actuator between the first end of said push-to-trip actuator and the second end of said push-to-trip actuator, said primary cover stop being structured to stop movement of said push-to-trip actuator away from the base of said housing when the primary cover is disposed on the base of said housing and the secondary cover of said housing is not coupled to the primary cover; and a secondary cover interface disposed at or about the first end of said push-to-trip actuator, said secondary cover interface being structured to engage the secondary cover of said housing when the secondary cover is coupled to the primary cover of said housing and said push-to-trip actuator is disposed in said first position.

8. The push-to-trip assembly of claim 7 wherein said push-to-trip actuator further comprises a first side and a second side; wherein said primary cover stop is a projection extending outwardly from the second side of said push-to-trip actuator; and wherein said projection is structured to engage the primary cover of said housing when the secondary cover of said housing is removed.

9. The push-to-trip assembly of claim 7 wherein the secondary cover of said housing of said electrical switching apparatus includes an opening and an edge; wherein the first end of said push-to-trip actuator comprises a notch; and wherein, when the secondary cover of said housing is coupled to the primary cover of said housing and said push-to-trip actuator is disposed in said first position, said notch is structured to engage the edge of the secondary cover at said opening.

10. The push-to-trip assembly of claim 9 wherein said push-to-trip actuator has a longitudinal axis; wherein the first end of said push-to-trip actuator is disposed at an angle with respect to the longitudinal axis; wherein said angle is greater than 90 degrees; wherein said notch of the first end of said push-to-trip actuator includes a contact surface; and wherein the contact surface of said notch is parallel with respect to the first end of said push-to-trip actuator.

11. An electrical switching apparatus comprising:

a housing including a base, a primary cover disposed on the base, a secondary cover coupled to the primary cover, and an exterior;

separable contacts enclosed by said housing;

an operating mechanism structured to open and close said separable contacts;

a trip bar cooperating with said operating mechanism to trip open said separable contacts; and a push-to-trip assembly comprising:

a push-to-trip actuator movably coupled to the base of said housing, said push-to-trip actuator comprising a first end and a second end disposed opposite and distal from the first end, the push-to-trip actuator being movable among a first position corresponding to said separable contacts being closeable, and a second position corresponding to the second end of said push-to-trip actuator cooperating with said trip bar to cause said operating mechanism to trip open said separable contacts, the first end of said push-to-trip actuator being accessible from the exterior of said housing to actuate said push-to-trip actuator from said first position to said second position, a biasing element biasing said push-to-trip actuator away from the base of said housing toward said first position, a primary cover stop disposed on said push-to-trip actuator between the first end of said push-to-trip actuator and the second end of said push-to-trip actuator, said primary cover stop stopping movement of said push-to-trip actuator away from the base of said housing when the primary cover is disposed on the base of said housing and the secondary cover of said housing is not coupled to the primary cover, a secondary cover interface disposed at or about the first end of said push-to-trip actuator, said secondary cover interface engaging the secondary cover of said housing when the secondary cover is coupled to the primary cover of said housing and said push-to-trip actuator is disposed in said first position, and an overtravel restraint disposed proximate to the second end of said push-to-trip actuator, said overtravel restraint restraining movement of said trip bar.

12. The electrical switching apparatus of claim 11 wherein said push-to-trip actuator further comprises a first side and a second side; wherein said primary cover stop is a projection extending outwardly from the second side of said push-to-trip actuator; and wherein said projection engages the primary cover of said housing when the secondary cover of said housing is removed.

13. The electrical switching apparatus of claim 11 wherein the base of said housing comprises a channel; wherein said push-to-trip actuator further comprises a first edge, a second edge disposed opposite the first edge, a first lateral protrusion extending outwardly from the first edge, a second lateral protrusion extending outwardly from the second edge, and a spring seat; wherein the first lateral protrusion and the second lateral protrusion movably engage the base of said housing at said channel in order to retain said push-to-trip actuator within said channel; wherein said biasing element of said push-to-trip assembly is a spring; and wherein said spring is generally disposed in said channel between said spring seat of said push-to-trip actuator and the base of said housing.

14. The electrical switching apparatus of claim 11 wherein said trip bar comprises at least one protrusion extending laterally outwardly from said trip bar; wherein said push-to-trip actuator further comprises an engagement segment extending outwardly from said push-to-trip actuator at or about the second end of said push-to-trip actuator; wherein, when said push-to-trip actuator is actuated from the first position toward the second position, said engagement segment engages a corresponding one of said at least one protrusion of said trip bar, thereby moving said trip bar to cause said operating mechanism to trip open said separable contacts; wherein said overtravel restraint of said push-to-trip actuator comprises a restraint segment disposed opposite and spaced apart from said engagement segment of said push-to-trip actuator; and wherein said corresponding one of said at least one protrusion of said trip bar is disposed between said engagement segment of said push-to-trip actuator and said restraint segment of said overtravel restraint, thereby restraining movement of said trip bar.

15. The electrical switching apparatus of claim 14 wherein said at least one protrusion of said trip bar is a first protrusion extending laterally outwardly from said trip bar and a second protrusion extending laterally outwardly from said trip bar generally opposite the first protrusion; wherein said push-to-trip actuator further comprises an interlock extending outwardly from said push-to-trip actuator at or about the second end of said push-to-trip actuator; wherein the first protrusion of said trip bar is disposed between said engagement segment of said push-to-trip actuator and said restraint segment of said overtravel restraint; and wherein the second protrusion of said trip bar cooperates with said interlock of said push-to-trip actuator to control movement of said trip bar.

16. The electrical switching apparatus of claim 15 wherein said interlock of said push-to-trip actuator is generally disposed opposite and spaced apart from said overtravel restraint of said push-to-trip actuator; wherein said biasing element is a spring; and wherein said spring is generally disposed between said interlock and said overtravel restraint.

17. The electrical switching apparatus of claim 11 wherein said push-to-trip actuator of said push-to-trip assembly has a longitudinal axis; wherein the second end of said push-to-trip actuator is disposed at an angle with respect to the longitudinal axis; wherein said angle is greater than 90 degrees; wherein the secondary cover of said housing includes an opening and an edge; wherein the second end of said push-to-trip actuator comprises a notch; wherein said notch of the second end of said push-to-trip actuator includes a contact surface; wherein the contact surface of said notch is parallel with respect to the second end of said push-to-trip actuator; and wherein, when the secondary cover of said housing is coupled to the primary cover of said housing and said push-to-trip actuator is disposed in said first position, the contact surface of said notch engages the edge of the secondary cover of said housing at said opening.

18. The electrical switching apparatus of claim 11 wherein the primary cover of said housing comprises a number of apertures; wherein the secondary cover of said housing comprises a number of protrusions; and wherein, when the secondary cover is coupled to the primary cover, each of said number of protrusions of the secondary cover is disposed in a corresponding one of said number of apertures of the primary cover.

19. The electrical switching apparatus of claim 18 wherein said number of protrusions of the secondary cover is a number of tabs; wherein the primary cover further comprises an outer surface and a number of cavities extending inwardly from the outer surface toward the base of said housing; and wherein, when the secondary cover is coupled to the primary cover, each of said number of tabs of the secondary cover is disposed in said corresponding one of said number of apertures of said primary cover and the secondary cover covers said number of cavities of the primary cover.

20. The electrical switching apparatus of claim 19 wherein the secondary cover further comprises at least one hole and at least one fastener; and wherein each of said at least one fastener is structured to be inserted through a corresponding one of said at least one hole of the secondary cover and fastened in order to fasten the secondary cover to the primary cover.

* * * * *